United States Patent [19]

Frank

[11] 4,362,282

[45] Dec. 7, 1982

[54] RAILROAD FROGS

[75] Inventor: Earl E. Frank, Tallman, N.Y.

[73] Assignee: Abex Corporation, Columbus, Ohio

[21] Appl. No.: 77,608

[22] Filed: Sep. 21, 1979

[51] Int. Cl.[3] ..... E01B 7/10

[52] U.S. Cl. ..... 246/468

[58] Field of Search ..... 246/468, 435 R, 457, 246/458, 471, 469, 470, 461, 391

[56] References Cited

U.S. PATENT DOCUMENTS

| | | | |
|---|---|---|---|
| 1,044,508 | 11/1912 | Elfborg | 246/468 |
| 2,690,316 | 9/1954 | Mahood | 246/468 |
| 4,081,162 | 3/1978 | Frank | 246/468 X |

*Primary Examiner*—Reinhard J. Eisenzopf

*Attorney, Agent, or Firm*—Kinzer, Plyer, Dorn & McEachran

[57] ABSTRACT

Railbound frogs for track work installation and so constructed as to strengthen the heel extension, to resist movement of the running rails away from the heel end of the frog and to prevent damage due to what is known as a "false flange" on the car wheel.

3 Claims, 7 Drawing Figures

RAILROAD FROGS

This invention relates to railbound frogs for trackwork installation and so constructed as to strengthen the heel extension, to resist movement of the running rails away from the heel end of the frog and to prevent damage due to what is known as a "false flange" on the car wheel. The achievements just mentioned constitute the objects of the present invention as will be explained in more detail below.

Figure 1:
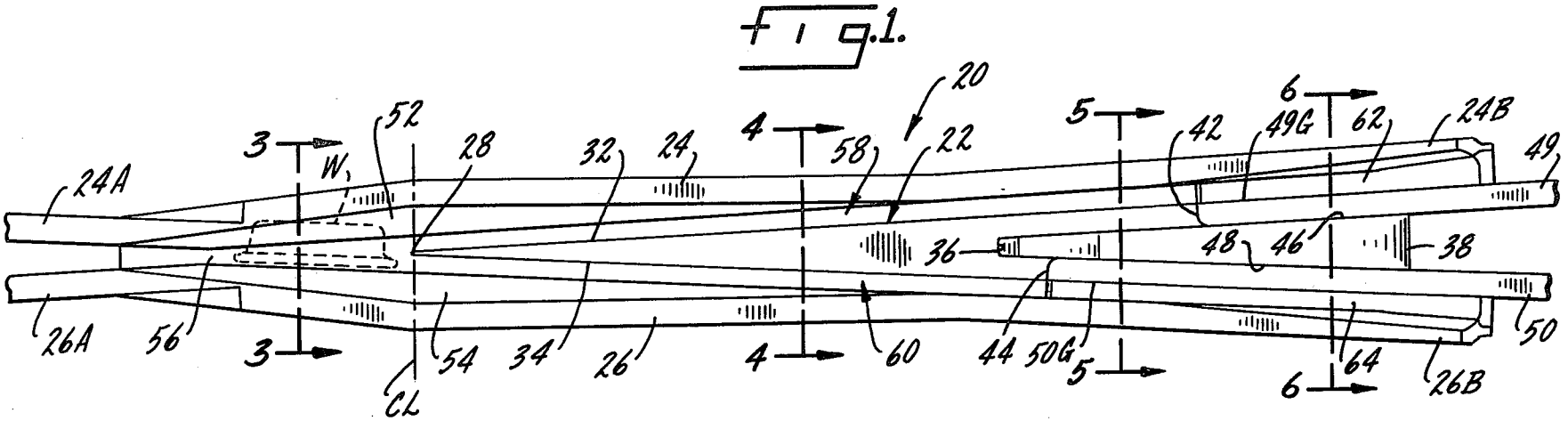
FIG. 1 is a plan view of a frog constructed in accordance with the present invention.

The frog 20 shown in FIG. 1 is a railbound frog in that the frog point 22, cast of manganese steel, is bound or guarded on opposite sides by a pair of wing rails 24 and 26 secured to the manganese casting by bolts which are not shown.

The frog point has a narrow end 28 (one-half inch wide) known as the (one-half inch) point-of-frog and the opposed gage lines 32 and 34 of the frog point diverge rearwardly from the point-of-frog toward the heel end 36. The heel end of the frog point 22 is cast with an integral heel extension 38.

In accordance with the present invention, the heel of the frog includes a pair of rail joints 42 and 44 aligned to the gage lines 32 and 34. The rail joints 42 and 44 are at different locations, which is to say that the rail joint 44 is considerably closer the one-half point-of-frog than the rail joint 42. The two rail joints terminate short of the remote end of the heel extension 38 and cooperate with the sides of the heel extension 38 to provide respective recesses 46 and 48 to which the ends of the running rails 49 and 50 are abutted, being spaced and aligned by the sides of the heel extension 38. Thus, the recesses 46 and 48 terminate at the rail joints 42 and 44 and cooperate with the sides of the heel extension 38, providing support for webs and the heads of rails 49 and 50 respectively.

Figure 5:
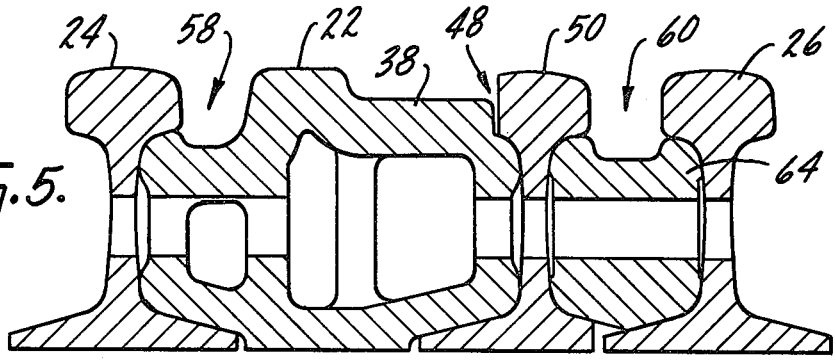

As noted above, the frog point 22 is a manganese steel casting. The staggered rail joints strengthen the heel extension which, it will be noted from FIGS. 5 and 6, has a hollow interior, boxed in, that is; if the rail joints were to be opposite one another this would represent a weaker section in comparison to the rail joints 42 and 48 being longitudinally displaced considerably from one another as will be apparent in FIG. 1. As a consequence, the heel end of the frog can support heavier loading for a longer time in comparison to the standard frog construction.

The frog casting 22 of manganese steel includes a left hand wing 52 of manganese steel and a similar right hand wing 54. These wings are closest to one another at the throat 56 of the frog and at the throat 56 the wing rails 24 and 26 present extensions 24A and 26A which will eventually meet the corresponding traffic rails.

At the end of the frog installation opposite the wing rail extensions 24A and 26A, the wings 24 and 26 are sloped outwardly considerably at 24B and 26B. Thus it will be seen that the wing rails 24 and 26 in effect extend from points forwardly of the frog throat 56 rearwardly to points beyond the end of the heel extension 38.

Figure 3:
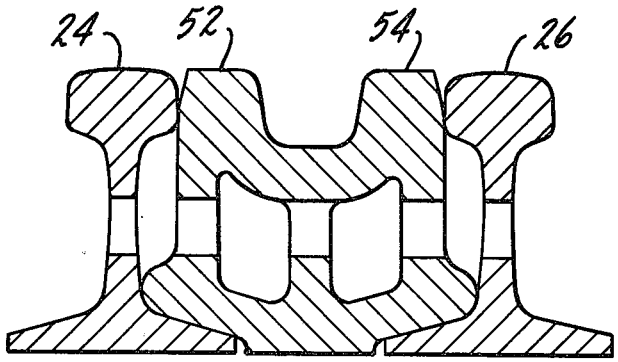
FIGS. 3–6 are section views taken respectively on the lines 3—3, 4—4, 5—5 and 6—6 of FIG. 1.
Figure 4:
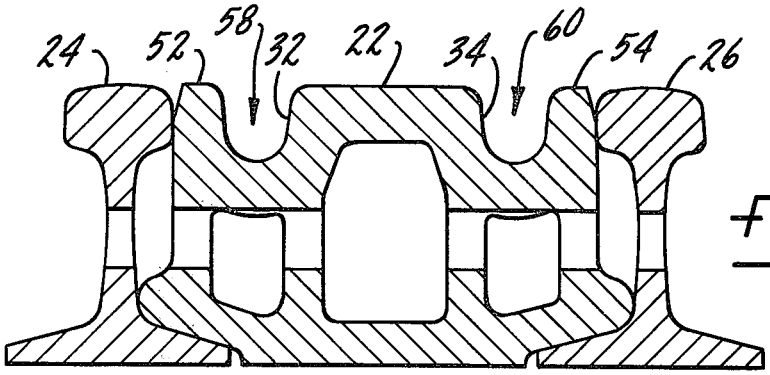

As best shown in FIG. 3, the point wings 52 and 54 of manganese steel present running surfaces in the plane of the heads of the wing rails 24 and 26. These running surfaces are separated from the gage lines of the point by the flangeways 58 and 60. As shown in FIG. 4 the upper surface of the frog point itself represents a running surface between the two gage lines 32 and 34. The running surfaces of the wings 52 and 54, FIG. 4, are narrow in this area.

Figure 7:
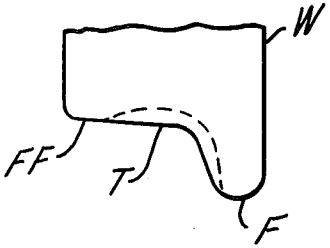
FIG. 7 is a fragmentary view of a car wheel.

FIG. 7 shows a fragment of the profile of a new car wheel W, the wheel having a flange F and a tread T. When the wheel traverses the frog, the flange F will be riding on either the flangeway 58 or the flangeway 60 while the tread T will be riding on the running surface of the point. In actual service, the wheel wears as shown by the dashed line in FIG. 7 resulting in a "false flange" FF at the back of the tread, that is, at the side of the wheel opposite the true flange F. In service, as the wheel W moves to the left as viewed in FIG. 1, off the point and onto the running surface of the manganese steel wing 52, a wheel with a false flange is riding "lower" because of the worn tread, and the false flange tends to better the manganese wing 52 causing the top surface of the wing 52, FIG. 3, to flow over onto the head of the opposed wing rail 24. Eventually the manganese is peened off by the false flange and repair service is required.

In accordance with the present invention, the wear on the manganese wing due to the false flange is considerably reduced, so that the service life of the frog will be extended, by having the greater width of the manganese wing running surface located at the so-called half-inch point of the frog which corresponds to the point-of-frog 28. So that this will be readily understood and recognized, a center line CL has been drawn in FIG. 1 showing that the widest areas of the manganese steel wings 52 and 54 occur coincident with the point-of-frog 28.

When traffic is moving from left to right as viewed in FIG. 1, that is, from the point-of-frog 28 toward the heel extension 38, there is a tendency to push the two running rails 49 and 50 away from the related rail joints 42 and 44. To prevent this, the ends of the traffic rails 49 and 50, in accordance with the present invention, are bent outwardly very slightly and are wedgingly held against displacement by complemental filler blocks 62 and 64 as will now be explained in detail.

Figure 2:
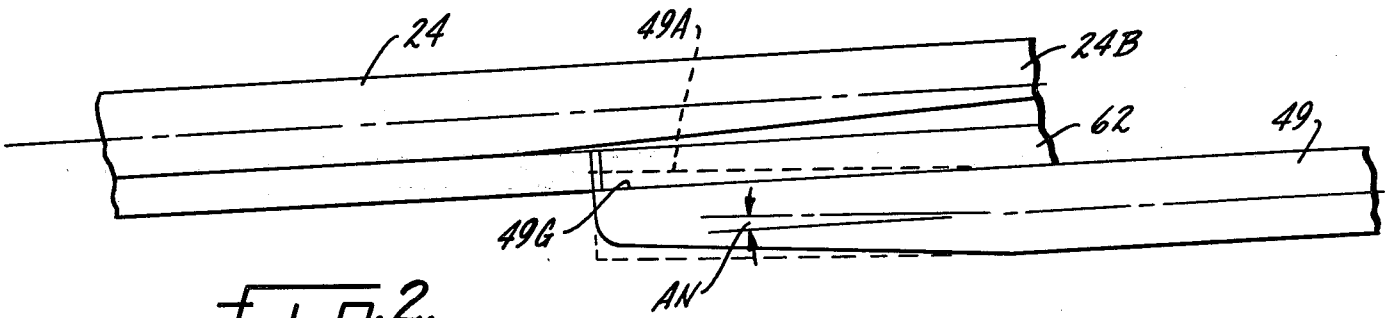
FIG. 2 is a detail view of a portion of FIG. 1 on a greatly enlarged scale.

The bend in the traffic rails 49 and 50 is too small to be discernible at the scale of FIG. 1 and is therefore shown on an exaggerated scale in FIG. 2. The bend may be as small as one-half inch in three feet, just sufficient to result in bending the web 49W, FIG. 6, of the rail 49 slightly outwardly in the direction of the flared end 24B of the wing rail 24. It is understood that there will be a similar outward bend in the web 50W of the other traffic rail 50 at the heel end of the point. Of course the head as 49H of each traffic rail will be bent outwardly at the same time, which would result in displacement of the side of the rail head into the flangeway and it is therefore necessary to shave or grind off the excess of the rail head to avoid interference with the flangeway. Thus, as shown in FIG. 2, what would be the interfering portion of the bent rail is shown by dashed line and denoted by reference character 49A. This excess is ground off or shaved off resulting in a smooth gage line 49G aligned to the gage line 32 of the frog point. The opposite traffic rail 50 is a similarly ground at the head so that its gage line 50G, FIG. 1, will be aligned to the gage line 34 of the frog point.

As will be recognized in FIG. 1, the traffic rails 49 and 50 are spaced inwardly from the wing rails so that there will be a continuation of the flangeways 58 and 60. As a result of outward bending of the webs of the traffic rails 49 and 50, the spacing between the traffic rails and the opposed portions of the wing rails is wedge shaped; complementally shaped spacers 62 and 64 are inserted into the wedge shaped spaces thereby to block the traffic rails 49 and 50 against longitudinal movement away from the frog point due to the loading of the traffic.

Figure 6:
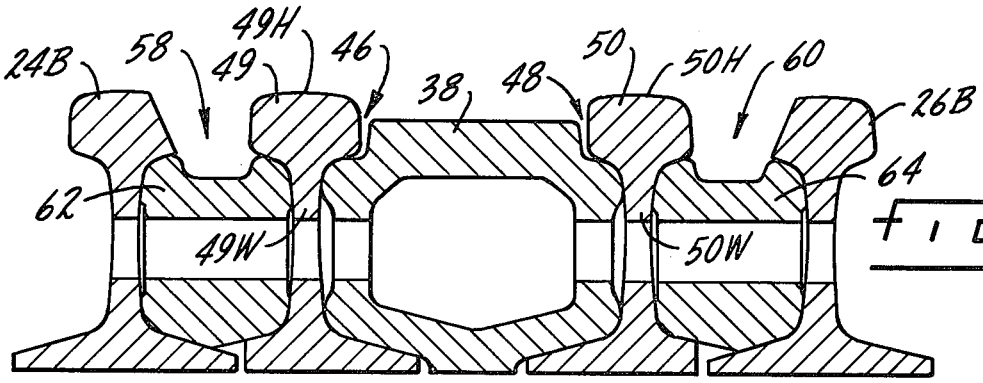

In other words, by bending the rail 49 the web 49W will be bent by a small angle AN, FIG. 2, which represents the wedge shape, and by nesting the complementally shaped spacer 62, FIG. 6, tightly between the flared end 24B of the wing rail 24 and the angled or bent web 49W it is not possible for the traffic rail 49 to be displaced in the longitudinal direction because of the wedging interference of the insert spacer 62. The spacer 64 associated with the other traffic rail 50 performs identically in preventing longitudinal displacement of rail 50.

It will be seen from the foregoing that the heel extension 38 is strengthened by the staggered location of the rail joints, the widest areas or sections of the manganese steel wings 52 and 54 are aligned to the point-of-frog 28 to afford more manganese metal for resisting plastic deformation due to battering or hammering by a false flange, and wedges 62 and 64 prevent displacement of the traffic rails 49 and 50.

I claim:

1. In a railroad frog for trackwork installation which includes a frog point casting with gage lines divergent from the narrow point-of-frog rearwardly to the heel of the frog, the heel of the frog having integrally cast thereto a heel extension with a hollow interior serving as a spacer for a pair of running rails to be aligned to said gage lines at the heel end of the frog casting, the improvement comprising:

a pair of rail joints cast integral with the frog point and extending rearwardly of the heel on opposite sides of said heel extension and cooperating with the heel extension to afford respective recesses for receiving the related end portions of the running rails; and one of said rail joints being considerably closer to the point-of-frog than the other.

2. A frog according to claim 1 including wing rails and in which said running rails have webs bent outwardly toward aft end portions of the wing rails and defining therewith wedge-shaped spaces, and separate fillers positioned complementally in said spaces thereby with the bent webs to resist movement of the running rails away from said rail joints.

3. In a railbound frog for trackwork installation which includes a frog point casting with gage lines divergent from the narrow point-of-frog rearwardly to the heel of the frog, the heel of the frog having integrally cast thereto a heel extension serving as a spacer for a pair of running rails to be aligned to said gage lines at the heel end of the frog casting, and having a pair of wing rails which extend from ends forwardly of the point-of-frog to aft end portions positioned rearwardly of the frog heel, the improvement comprising:

said running rails having webs bent outwardly toward said aft end portions of the wing rails and defining therewith wedge-shaped spaces, and separate fillers positioned complementally in said spaces thereby with the bent webs to resist movement of the running rails away from said heel extension.

* * * * *